US006807834B2

(12) United States Patent
Tsai

(10) Patent No.: US 6,807,834 B2
(45) Date of Patent: Oct. 26, 2004

(54) ELECTRIC DOOR LOCK WITH A COUPLING MECHANISM FOR SELECTIVE ENGAGEMENT BETWEEN A DEADBOLT OPERATING SPINDLE AND A DOOR HANDLE

(75) Inventor: Hung-Cheng Tsai, Chia-Yi (TW)

(73) Assignee: EZ Trend Technology Co, Ltd., Chia-yi (TW)

( * ) Notice: Subject to any disclaimer, the term of this patent is extended or adjusted under 35 U.S.C. 154(b) by 0 days.

(21) Appl. No.: 10/447,138

(22) Filed: May 29, 2003

(65) Prior Publication Data

US 2004/0177660 A1 Sep. 16, 2004

(51) Int. Cl.[7] ..... E05B 13/10

(52) U.S. Cl. ..... 70/472; 70/149; 70/218; 70/223; 70/224; 70/277; 70/279.1

(58) Field of Search ..... 70/277, 223, 224, 70/279.1, 188, 189, 422, 472, 149, 218; 292/DIG. 27

(56) References Cited

U.S. PATENT DOCUMENTS

| | | | | | |
|---|---|---|---|---|---|
| 3,477,261 | A | | 11/1969 | Siana | |
| 3,797,004 | A | | 3/1974 | Mussel et al. | 70/DIG. 49 X |
| 4,070,882 | A | | 1/1978 | Ruiz | 70/427 |
| 4,073,527 | A | * | 2/1978 | Schlage | 292/347 |
| 4,671,087 | A | * | 6/1987 | Olenfalk et al. | 70/283 |
| 4,726,206 | A | | 2/1988 | Hsu | 70/441 |
| 5,000,018 | A | * | 3/1991 | Eisermann | 70/277 |
| 5,018,375 | A | * | 5/1991 | Tully | 70/472 |
| 5,040,391 | A | * | 8/1991 | Lin | 70/277 |
| 5,195,342 | A | | 3/1993 | Werner | 70/417 |
| 5,199,288 | A | * | 4/1993 | Merilainen et al. | 70/279.1 |
| 5,421,178 | A | * | 6/1995 | Hamel et al. | 70/283 |
| 5,475,996 | A | * | 12/1995 | Chen | 70/279.1 |
| 5,598,725 | A | | 2/1997 | Chang | 70/209 |
| 5,628,216 | A | * | 5/1997 | Qureshi et al. | 70/278.7 |
| 5,791,177 | A | * | 8/1998 | Bianco | 70/283.1 |
| 5,927,112 | A | | 7/1999 | Yamashita | 70/252 |
| 6,145,353 | A | * | 11/2000 | Doucet | 70/277 |
| 6,334,348 | B1 | * | 1/2002 | Ming-Chih | 70/472 |
| 6,487,884 | B1 | * | 12/2002 | Constantinou | 70/277 |
| 6,598,439 | B1 | | 7/2003 | Chen | 70/423 |
| 6,640,594 | B1 | * | 11/2003 | Yao | 70/277 |
| 6,725,693 | B2 | * | 4/2004 | Yu et al. | 70/107 |
| 2001/0005998 | A1 | * | 7/2001 | Ocana | 70/277 |

FOREIGN PATENT DOCUMENTS

| | | | | |
|---|---|---|---|---|
| DE | 355578 | * | 6/1922 | 292/DIG. 27 |
| FR | 12097 | * | 7/1910 | 292/DIG. 27 |

* cited by examiner

*Primary Examiner*—Lloyd A. Gall
(74) *Attorney, Agent, or Firm*—Baker Botts L.L.P.

(57) ABSTRACT

An electric door lock includes a deadbolt, a deadbolt operating spindle, a door handle, and a coupling mechanism. The spindle is coupled to the deadbolt and is capable of driving movement of the deadbolt between locking and unlocking positions. The coupling mechanism includes an engaging member, a push unit, and an electric driving motor unit. The engaging member is coupled co-rotatably to the spindle and is axially movable relative to the spindle from a first axial position, where the engaging member can be disengaged from the door handle, to a second axial position, where the engaging member engages the door handle such that rotation of the door handle results in corresponding rotation of the spindle. The push unit is driven by the motor unit so as to move the engaging member from the first axial position to the second axial position.

14 Claims, 8 Drawing Sheets

ELECTRIC DOOR LOCK WITH A COUPLING MECHANISM FOR SELECTIVE ENGAGEMENT BETWEEN A DEADBOLT OPERATING SPINDLE AND A DOOR HANDLE

BACKGROUND OF THE INVENTION

1. Field of the Invention

The invention relates to an electric door lock, more particularly to an electric door lock with a coupling mechanism for selective engagement between a deadbolt operating spindle and a door handle.

2. Description of the Related Art

A conventional manually operated door lock for locking and unlocking a door panel on a door frame includes a deadbolt, a rotary handle for operating the deadbolt, a latchbolt, and a door knob for operating the latchbolt. The door panel has an inner surface, an outer surface, and a peripheral surface that interconnects the inner and outer surfaces. The door frame is formed with first and second locking grooves. Each of the deadbolt and the latchbolt is adapted to be mounted on the peripheral surface of the door panel. The deadbolt is operable for movement between a locking position, where the deadbolt is extended relative to the peripheral surface of the door panel so as to be adapted to engage the first locking groove in the door frame, and an unlocking position, where the deadbolt is retracted relative to the peripheral surface of the door panel so as to be adapted to disengage from the first locking groove in the door frame. The latchbolt is operable for movement between a latching position, where the latchbolt is extended relative to the peripheral surface of the door panel so as to be adapted to engage the second locking groove in the door frame and retain the door panel in a closed position, and a non-latching position, where the latchbolt is retracted relative to the peripheral surface of the door panel so as to be adapted to disengage from the second locking groove in the door frame and permit opening movement of the door panel.

When one of the deadbolt and the latchbolt is at the respective locking or latching position, operation of the door knob or the rotary handle to move the other of the deadbolt and the latchbolt to the respective unlocking or non-latching position does not permit opening movement of the door panel. In other words, the deadbolt has to be in the unlocking position and the latchbolt has to be in the non-latching position before opening movement of the door panel is possible.

Although the aforementioned conventional door lock achieves the purpose of locking and unlocking the door panel on the door frame, the conventional door lock includes numerous components and requires the deadbolt and the latchbolt to be in proper positions before a door panel can be opened.

SUMMARY OF THE INVENTION

Therefore, the object of the present invention is to provide an electric door lock that can overcome the aforesaid drawbacks of the prior art.

According to the present invention, an electric door lock for a door panel comprises a deadbolt, a deadbolt operating spindle, a door handle, and a coupling mechanism. The deadbolt is adapted to be mounted on the door panel and is operable for movement between a locking position, where the deadbolt is extended relative to the door panel, and an unlocking position, where the deadbolt is retracted relative to the door panel. The deadbolt operating spindle is coupled to the deadbolt and is capable of driving movement of the deadbolt between the locking and unlocking positions. The door handle is adapted to be mounted rotatably on the door panel. The coupling mechanism is adapted to be mounted on the door panel, and includes an engaging member, a push unit, and an electric driving motor unit. The engaging member is coupled co-rotatably to the spindle and is axially movable relative to the spindle from a first axial position, where the engaging member can be disengaged from the door handle, to a second axial position, where the engaging member engages the door handle such that rotation of the door handle results in corresponding rotation of the spindle. The push unit, which is driven by the motor unit, is operable so as to move the engaging member from the first axial position to the second axial position.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
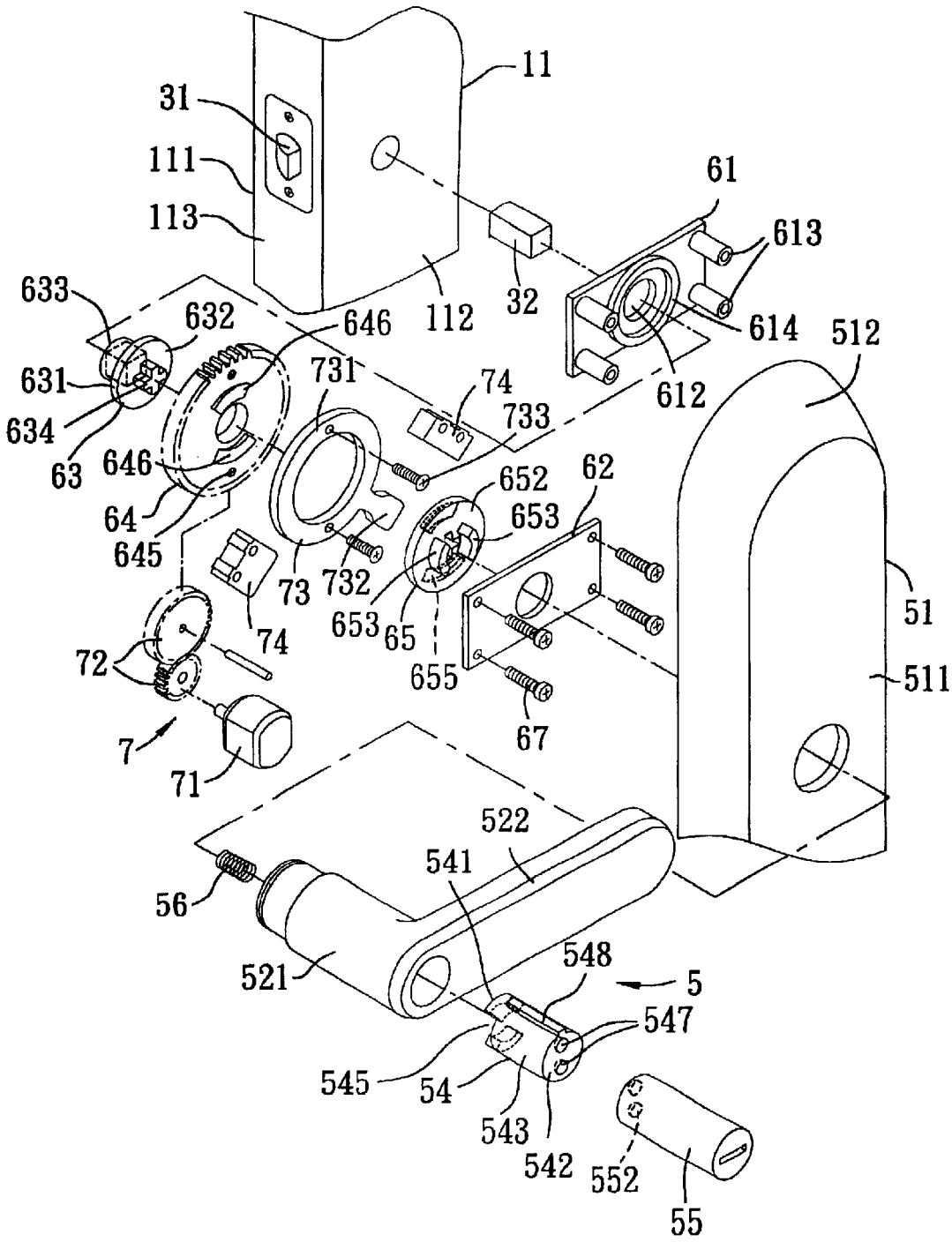
FIG. 1 is an exploded perspective view of the first preferred embodiment of an electric door lock according to the present invention.

Before the present invention is described in greater detail, it should be noted that like elements are denoted by the same reference numerals throughout the disclosure.

Figure 2:
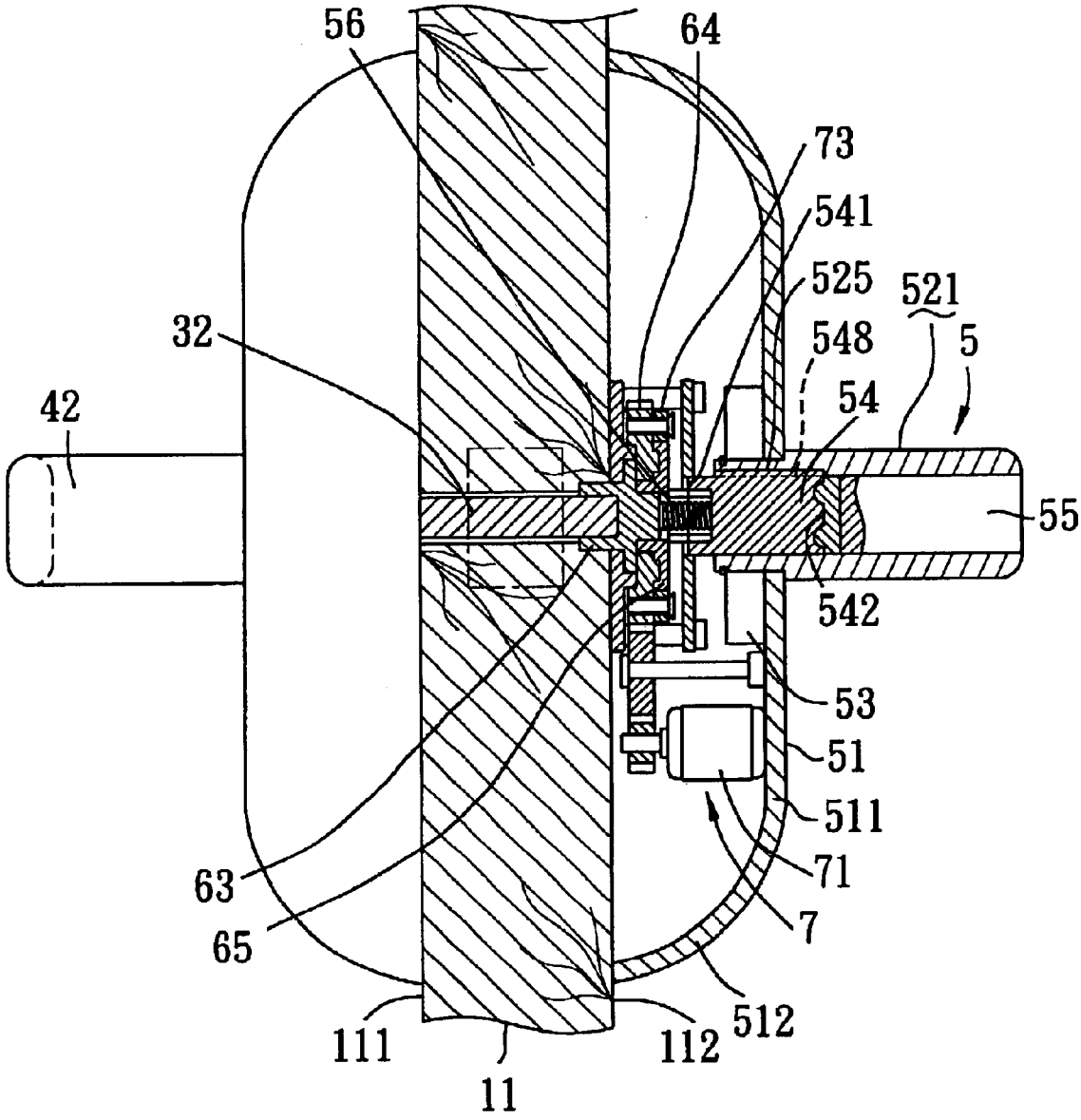
FIG. 2 is a sectional view of the first preferred embodiment in an assembled state.
Figure 3:
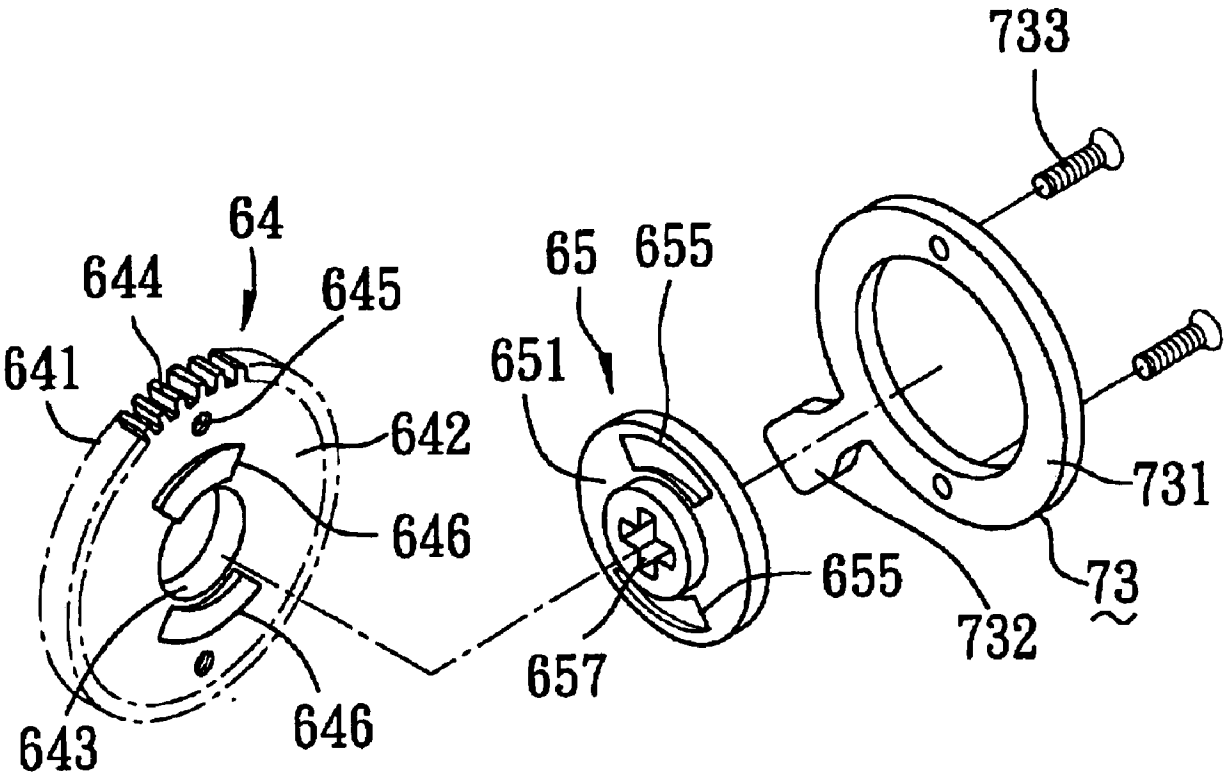
FIG. 3 is an exploded perspective view of a gear member, a first engaging member, and a switch actuator of the first preferred embodiment.

Referring to FIGS. 1 to 3, the first preferred embodiment of an electric door lock is adapted to be installed on a door panel 11 and is shown to include a deadbolt 31, a deadbolt operating spindle 32, an outer door handle 5, and a coupling mechanism.

The door panel 11 has an inner surface 111, an outer surface 112, and a peripheral surface 113 that interconnects the inner and outer surfaces 111, 112.

The deadbolt 31 is adapted to be mounted on the peripheral surface 113 of the door panel 11 and is operable for movement between a locking position, where the deadbolt 31 is extended relative to the peripheral surface 113 of the door panel 11, and an unlocking position, where the deadbolt 31 is retracted relative to the peripheral surface 113 of the door panel 11.

The spindle 32 is coupled to the deadbolt 31 and is capable of driving movement of the deadbolt 31 between the locking and unlocking positions. Since the feature of the present invention does not reside in the particular connection between the deadbolt 31 and the spindle 32, which is conventional in construction, a detailed description of the same is omitted herein for the sake of brevity.

An inner door handle 42 is adapted to be mounted rotatably on the inner surface 111 of the door panel 11, is coupled to the spindle 32, and is operable to drive rotation of the spindle 32 in a known manner.

A lock housing 51 is adapted to be mounted on the outer surface 112 of the door panel 11, and has a base wall 511 that is formed with a handle hole therethrough, and a surrounding wall 512 that extends from a periphery of the base wall 511. The base and surrounding walls 511, 512 cooperate to confine the coupling mechanism therein.

The outer door handle 5 includes a tubular space-confining wall 521 that defines a lock-mounting space. The space-confining wall 521 extends rotatably into the lock housing 51 through the handle hole, and has an inner end portion disposed in the lock housing 51 and an outer end portion disposed externally of the lock housing 51. A lever 522 extends radially and outwardly from the outer end portion of the space-confining wall 521 and is operable so as to rotate the space-confining wall 521.

A known spring unit 53 is mounted in the lock housing 51, is coupled to the space-confining wall 521, and biases the outer door handle 5 to an initial position.

The coupling mechanism is adapted to be mounted on the door panel 11, and includes a first engaging member 65, a push unit and an electric driving motor unit 7.

The first engaging member 65 is coupled co-rotatably to the spindle 32, is axially movable relative to the spindle 32 from a first axial position to a second axial position, and has a first engaging surface 651 and a second engaging surface 652 opposite to the first engaging surface 651.

The push unit is operable so as to move the first engaging member 65 from the first axial position to the second axial position, and includes a gear member 64 coupled to and driven rotatably by the motor unit 7. The gear member 64 has a first gear surface 641 and a second gear surface 642 that is opposite to the first gear surface 641 and that confronts the first engaging surface 651 of the first engaging member 65, and is formed with an axial hole 643 that extends from the first gear surface 641 to the second gear surface 642. The gear member 64 has a toothed periphery 644 between the first and second gear surfaces 641, 642. Preferably, the push unit further includes a projection unit 646 formed on the second gear surface 642 of the gear member 64, and a groove unit 655 formed in the first engaging surface 651 of the first engaging member 65. In this embodiment, the projection unit 646 includes a pair of circumferentially extending projections angularly displaced from each other. Each of the projections has first and second ends opposite to each other in the circumferential direction, and a thickness that gradually increases from the first end to the second end. The groove unit 655 includes a pair of grooves that complement the projections.

The motor unit 7 drives rotation of the gear member 64 between an aligning position, in which the projection unit 646 is aligned with and is able to move into the groove unit 655, and a misaligning position, in which the projection unit 646 is misaligned from and is able to move out of the groove unit 655. The motor unit 7 includes a motor 71 with a shaft, and a gear set 72 mounted to rotate with the shaft of the motor 71 and meshing with the gear member 64.

The coupling mechanism further includes a coupling member 63 that has a first coupling surface 631 and a second coupling surface 632 opposite to the first coupling surface 631. The first coupling surface 631 is formed with a sleeve 633. The second coupling surface 632 abuts against the first gear surface 641 of the gear member 64. Preferably, the spindle 32 has a rectangular cross-section along a vertical plane, and the sleeve 633 is formed with a recess that complements the rectangular cross-section of the spindle 32 so as to be sleeved fittingly on one end of the spindle 32.

An engaging unit includes an engaging hole 657 formed in the first engaging surface 651 of the first engaging member 65, and an engaging protrusion 634 formed on the second coupling surface 631 of the coupling member 63. Preferably, the engaging protrusion 634 has a cross-shaped cross section along the vertical plane, and the engaging hole 657 complements the cross section of the engaging protrusion 634 so as to permit the engaging protrusion 634 to extend through the axial hole 643 in the gear member 64 and engage the engaging hole 657 for interconnecting co-rotatably the coupling member 63 and the first engaging member 65 while permitting axial movement of the first engaging member 65 between the first and second axial positions.

The outer door handle 5 further includes a second engaging member 54, an urging member 56, and a lock core 55. The second engaging member 54 is received in the lock-mounting space defined by the space-confining wall 521 so as to be co-rotatable with and be axially movable between first and second positions relative to the space-confining wall 521. In particular, the second engaging member 54 has first and second engaging ends 541, 542, and an engaging wall 543 that interconnects the first and second engaging ends 541, 542. The engaging wall 543 of the second engaging member 54 is formed with a latching projection 548. The space-confining wall 521 is formed with a retaining notch 525 that engages the latching projection 548 to guide movement of the second engaging member 54 between the first and second positions. In this embodiment, the second engaging surface 652 of the first engaging member 65 is formed with a pair of locking projections 653. The first engaging end 541 of the second engaging member 54 is formed with a pair of engaging notches 545 that engage removably the locking projections 653 to transmit rotation of the second engaging member 54 to the first engaging member 65.

The urging member 56 is disposed between the first engaging member 65 of the coupling mechanism and the second engaging member 54 of the outer door handle 5, biases the first engaging member 65 from the second axial position to the first axial position and further biasing the second engaging member 54 from the first position to the second position.

The lock core 55 is disposed in the lock-mounting space defined by the space-confining wall 521, is coupled to the second engaging member 54, and is adapted to be operated by a corresponding key (not shown) for moving the second engaging member 54 from the second position to the first position. In this embodiment, the lock core 55 has a pair of knobs 552 formed thereon, and the second engaging end 542 of the second engaging member 54 is formed with a pair of recesses 547 that complement the knobs 552.

The coupling mechanism further includes a frame unit. The frame unit includes first and second frame parts 61, 62. The first and second frame parts 61, 62 are generally rectangular in shape. The frame unit further includes four connecting rods 613, each of which has a mounting end mounted securely on one of the four corners of the first frame part 61 and a threaded end formed with a threaded hole. Each of the four corners of the second frame part 62 is formed with four fastener holes therethrough, each of which is aligned with one of the threaded holes in the rods 613. Fasteners 67 are inserted respectively through the fastener holes and threaded into the threaded holes for fastening together the first and second frame parts 61, 62 so as to confine the coupling member 63, the gear member 64, and the first engaging member 65 there between. The first frame part 61 is further formed with a through hole 612 that permits the sleeve 633 of the coupling member 63 to extend rotatably therethrough, and an annular wall 614 that surrounds the through hole 612 and that defines a cavity to rotatably confine the coupling member 63. The second frame part 62 permits extension of the locking projections 653 of the first engaging member 65 therethrough when the first engaging member 65 moves from the first axial position to the second axial position so as to engage the engaging notches 545 in the second engaging member 54 of the outer door handle 5. Further, the second frame part 62 permits extension of the second engaging member 54 therethrough when the second engaging member 54 moves from the second position to the first position so as to inter-engage the locking projections 653 of the first engaging member 65 and the engaging notches 545 in the second engaging member 54.

The coupling mechanism further includes a pair of contact switches 74 that are connected electrically to the motor unit 7, that are operable so as to deactivate the motor unit 7 when actuated, and that are angularly displaced from each other. A switch actuator 73 is mounted on the gear member 64 for co-rotation therewith, is capable of actuating the contact switches 74, and includes a ring 731 and an actuating arm 732 that extends from a periphery of the ring 731. In this embodiment, the gear member 64 is formed with a pair of threaded holes 645. The ring 731 is formed with fastener holes that are aligned with the threaded holes 645 in the gear member 64. Fasteners 733 are inserted respectively through the fastener holes in the ring 731 and threaded into the threaded holes 645 in the gear member 64 for fastening together the switch actuator 73 and the gear member 64. As such, when the gear member 64 is rotated to the aligning position, the actuating arm 732 comes into contact with and actuates one of the contact switches 74, and when the gear member 64 is rotated to the misaligning position, the actuating arm 732 comes into contact with and actuates the other one of the contact switches 74.

Figure 4:
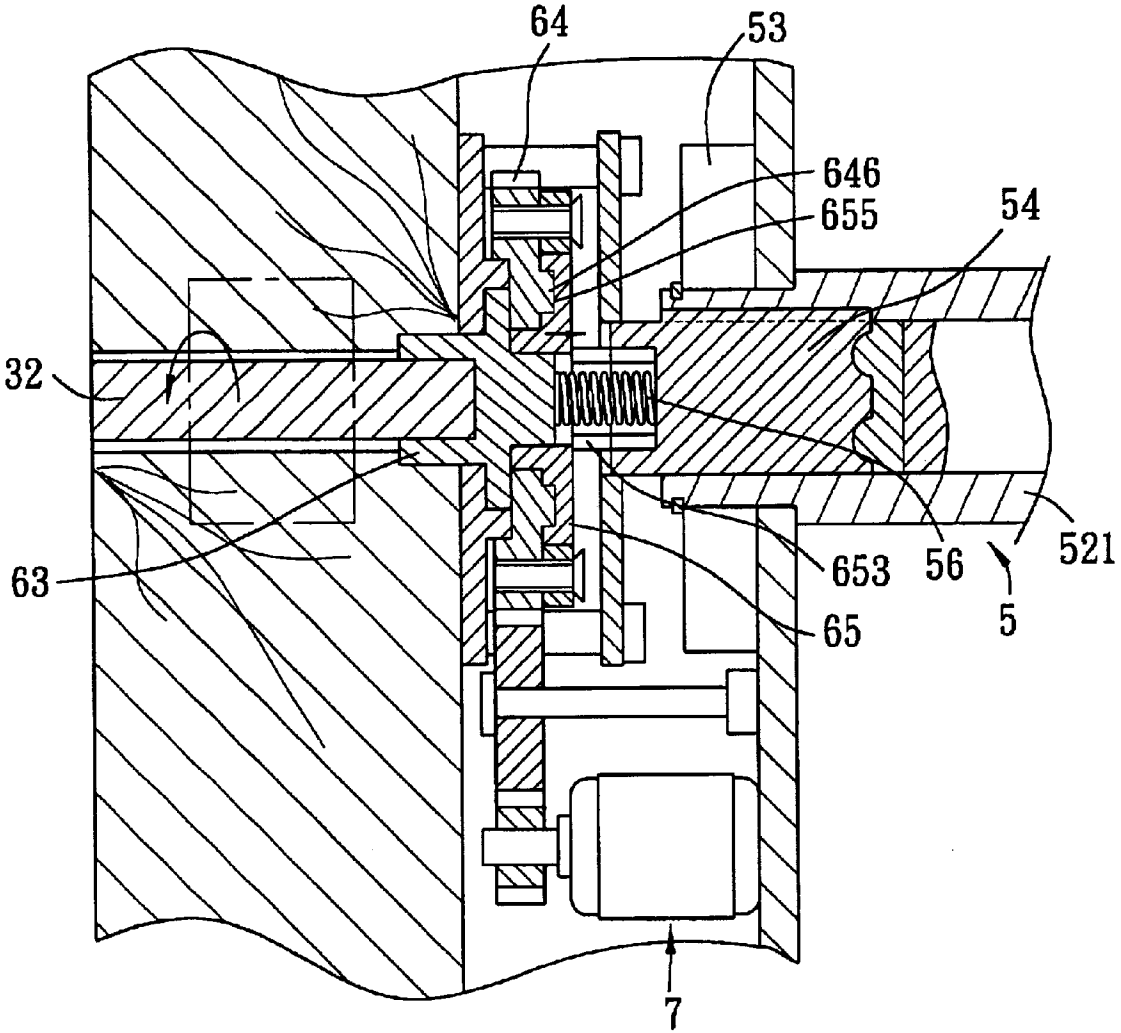
FIG. 4 is a fragmentary sectional view of the first preferred embodiment to illustrate how a projection unit is aligned and moved into a groove unit.
Figure 5:
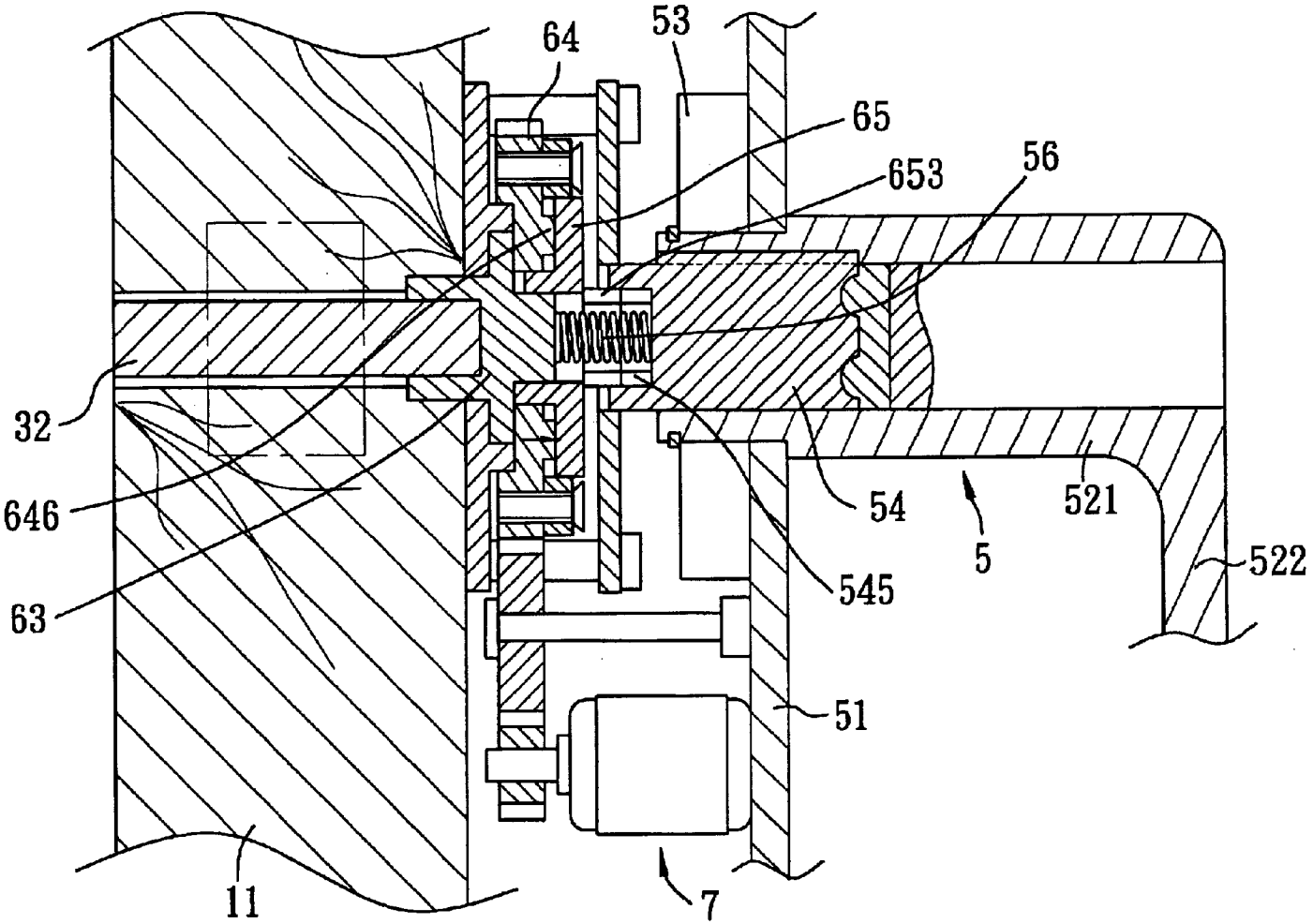
FIG. 5 is a fragmentary sectional view of the first preferred embodiment to illustrate how the projection unit is misaligned and moved out of the groove unit.

Referring to FIG. 4, when an operating force is applied to operate the inner door handle 42 (see FIG. 1) such that the spindle 32 is rotated to drive movement of the deadbolt 31 (see FIG. 1) to the unlocking position, this results in rotation of the coupling member 63, which in turn rotates the first engaging member 65. Since the gear member 64 does not rotate, the rotation of the first engaging member 65 enables the projection unit 646 of the gear member 64 to move out of and to misalign from the groove unit 655 in the first engaging member 65. As a result, the first engaging member 65 moves from the first axial position to the second axial position against the biasing action of the urging member 56 so as to result in engagement among the locking projections 653 of the first engaging member 65 and the engaging notches 545 in the second engaging member 54, as best shown in FIG. 5. Accordingly, the rotation of the spindle 32 is transmitted through the coupling member 63 and the first engaging member 65 so as to rotate the second engaging member 54. This results in rotation the space-confining wall 521 of the outer door handle 5 from the initial position against biasing action of the spring unit 53.

Conversely, referring to FIG. 5, when the operating force on the inner door handle 42 (see FIG. 1) is released, this results in rotation of the space-confining wall 521 of the outer door handle 5 back to the initial position due to restoring action of the spring unit 53. This in turn rotates the second engaging member 54. Since the locking projections 653 of the first engaging member 65 still engage the engaging notches 545 in the second engaging member 54, the rotation of the second engaging member 54 is transmitted to rotate the first engaging member 65. The rotation of the first engaging member 65, which in turn rotates the coupling member 63, rotates the spindle 32 to drive movement of the deadbolt 31 to the locking position. Moreover, since the gear member 64 still does not rotate, the rotation of the first engaging member 65 enables the projection unit 646 of the gear member 64 to align with and move into the groove unit 655 in the first engaging member 65. This then moves the first engaging member 65 from the second axial position to the first axial position due to the restoring action of the urging member 56, thereby disengaging the locking projections 653 of the first engaging member 65 from the engaging notches 545 in the second engaging member 54. At this time, because the first and second engaging members 65, 54 are disengaged from each other, operation of the lever 522 of the outer door handle 5 does not result in corresponding rotation of the spindle 32.

Referring to back to FIG. 4, when the motor unit 7 is activated, such as with the use of a remote controller (not shown), so as to rotate the gear member 64 from the aligning position to the misaligning position, this results in axial movement of the first engaging member 65 from the first axial position to the second axial position against biasing action of the urging member 56, thereby resulting in engagement among the locking projections 653 of the first engaging member 65 and the engaging notches 545 in the second engaging member 54. At this time, operation of the lever 522 of the outer door handle 5 results in corresponding rotation of the spindle 32 to drive movement of the deadbolt 31 (see FIG. 1) between the locking and unlocking positions.

Conversely, referring back to FIG. 5, when the gear member 64 is rotated by the motor unit 7 from the misaligning position to the aligning position, this results in axial movement of the first engaging member 65 from the second axial position to the first axial position due to the restoring action of the urging member 56, thereby disengaging the locking projections 653 of the first engaging member 65 from the engaging notches 545 in the second engaging member 54. At this time, operation of the lever 522 of the outer door handle 5 does not result in corresponding rotation of the spindle 32.

Figure 6:
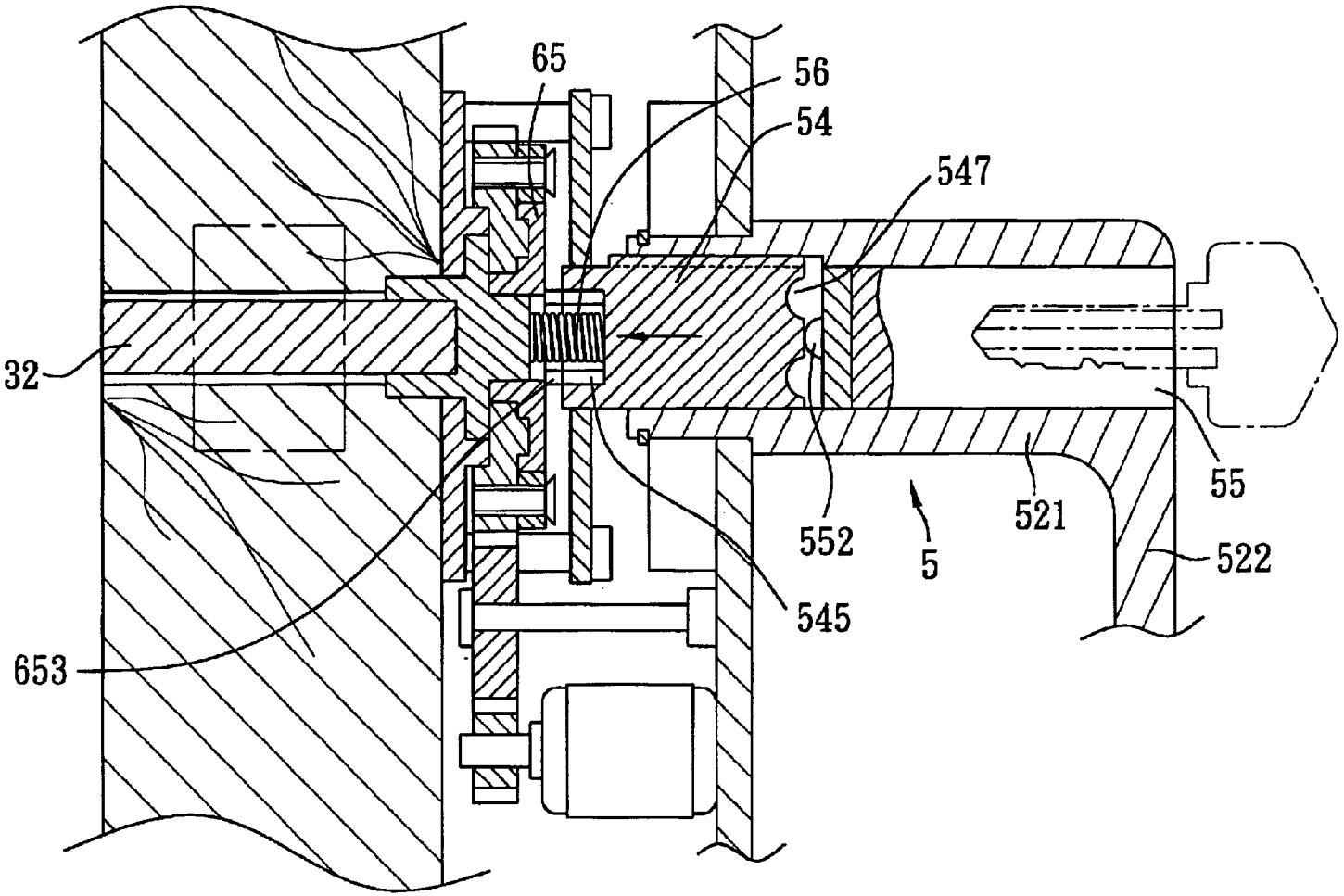
FIG. 6 is a fragmentary sectional view of the first preferred embodiment to illustrate how knobs are misaligned and moved out of recesses.

Referring to FIG. 6, when the lock core 55 is rotated with the use of a key to misalign the knobs 552 from the recesses 547 and to permit movement of the knobs 552 out of the recesses 547, this results in axial movement of the second engaging member 54 from the second position to the first position against the biasing action of the urging member 56 so as to inter-engage the engaging notches 545 in the second engaging member 54 and the locking projections 653 of the first engaging member 65. At this time, operation of the lever 522 of the outer door handle 5 results in corresponding rotation of the spindle 32 to drive movement of the deadbolt 31 (see FIG. 1) between the locking and unlocking positions.

Figure 7:
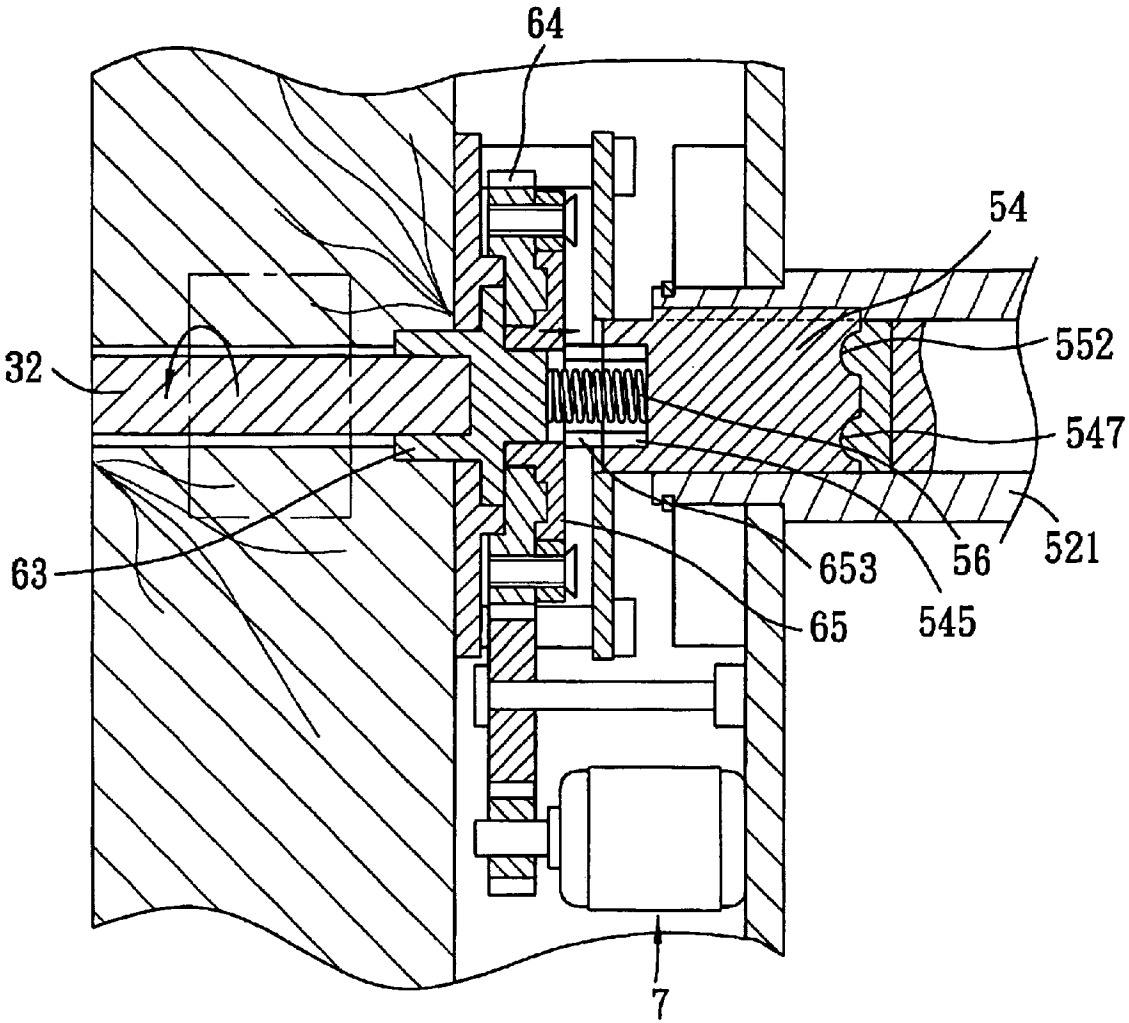
FIG. 7 is a fragmentary sectional view of the first preferred embodiment to illustrate how the knobs are aligned and moved into the recesses.

Conversely, referring to FIG. 7, when the lock core 55 is rotated with the use of the key (not shown) to align the knobs 552 with the recesses 547 and to permit movement of the knobs 552 into the recesses 547, this results in axial movement of the second engaging member 54 from the first position to the second position due to the restoring action of the urging member 56, thereby disengaging the locking projections 653 of the first engaging member 65 from the engaging notches 545 in the second engaging member 54. At this time, operation of the lever 522 (not shown) of the outer door handle 5 does not result in corresponding rotation of the spindle 32.

Figure 8:
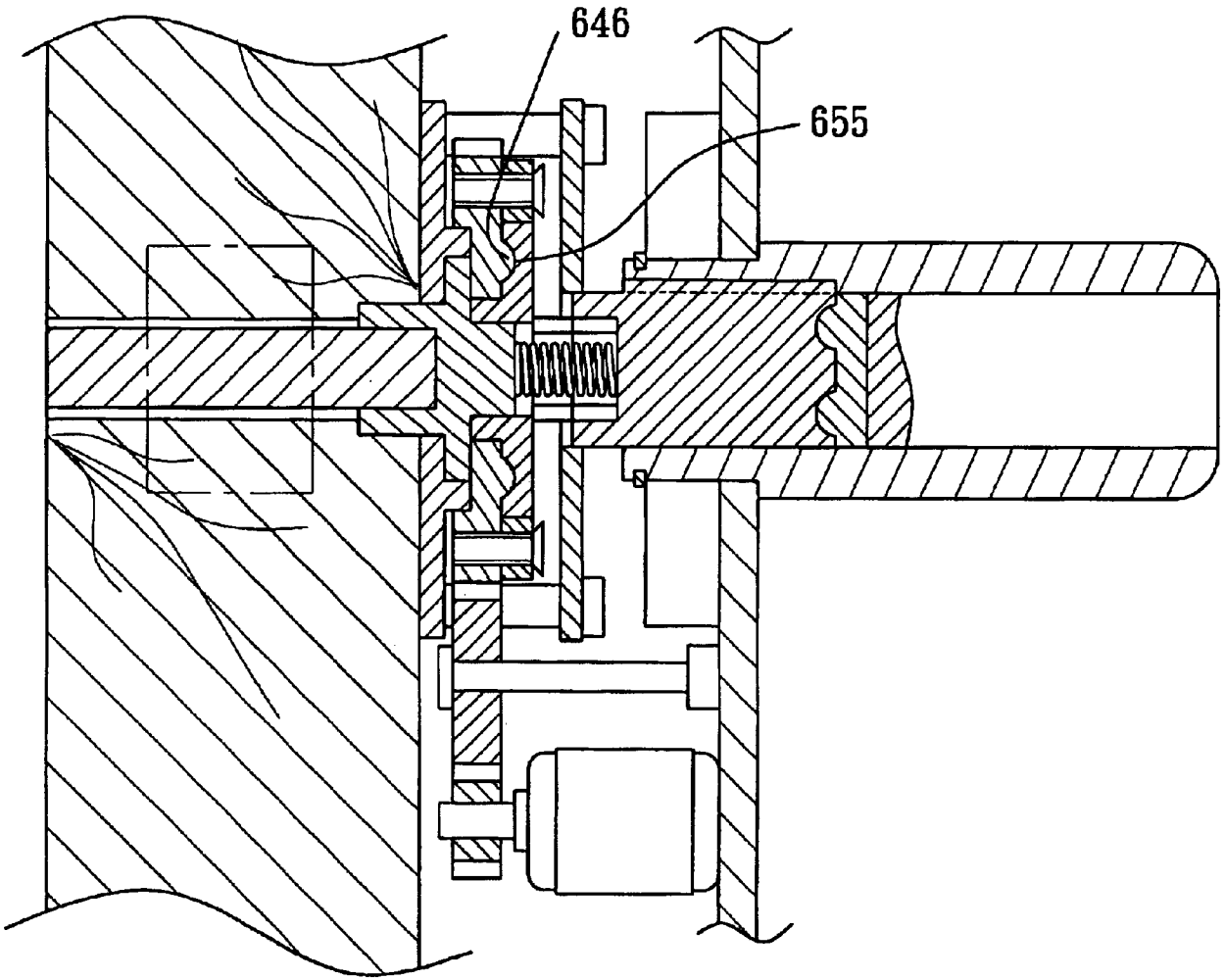
FIG. 8 is a sectional view of the second preferred embodiment of an electric door lock according to the present invention.

FIG. 8 shows the second preferred embodiment of an electric door lock according to the present invention. This embodiment differs from the previous embodiment in that the projection unit 646 includes a pair of hemispherical projections angularly displaced from each other, and the groove unit 655 includes a pair of grooves that complement the projections.

It has thus been shown that the electric door lock of this invention includes a coupling mechanism that selectively engages and disengages a deadbolt operating spindle 32 to an outer door handle 5. The construction as such permits the outer door handle 5 to be enabled such that operation of the outer door handle 5 results in corresponding rotation of the spindle 32 to drive movement of a deadbolt 31 between locking and unlocking positions, and to be disabled such that operation of the outer door handle 5 does not result in corresponding rotation of the spindle 32 to drive movement of the deadbolt 31 between locking and unlocking positions.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. An electric door lock for a door panel, said electric door lock comprising:

a deadbolt adapted to be mounted on the door panel and operable for movement between a locking position, where said deadbolt is extended relative to the door panel, and an unlocking position, where said deadbolt is retracted relative to the door panel;

a deadbolt operating spindle coupled to said deadbolt and capable of driving movement of said deadbolt between the locking and unlocking positions;

a door handle adapted to be mounted rotatable on the door panel; and a coupling mechanism adapted to be mounted on the door panel and including a first engaging member coupled co-rotatably to said spindle and axially movable relative to said spindle from a first axial position to a second axial position, where said first engaging member engages said door handle such that rotation of said door handle results in corresponding rotation of said spindle, a push unit operable so as to move said first engaging member from the first axial position to the second axial position, and an electric driving motor unit for driving operation of said push unit, wherein said first engaging member has a first engaging surface and a second engaging surface opposite to said first engaging surface, said push unit including a gear member coupled to and driven rotatably by said motor unit, said gear member having a first gear surface and a second gear surface that is opposite to said first gear surface and that confronts said first engaging surface of said first engaging member, a projection unit formed on one of said second gear surface of said gear member and said first engaging surface of said first engaging member, and a groove unit formed in the other of said second gear surface of said gear member and said first engaging surface of said first engaging member, said first engaging member being disposed in the first axial position when said gear member is rotated by said motor unit to align said projection unit with said groove unit and to enable said projection unit to move into said groove unit, said first engaging member being disposed in the second axial position when said gear member is rotated by said motor unit to misalign said projection unit from said groove unit and to enable said projection unit to move out of said groove unit.

2. The electric door lock as claimed in claim 1, wherein said coupling mechanism further includes an urging member disposed between said first engaging member and said door handle for biasing said first engaging member from the second axial position to the first axial position.

3. The electric door lock as claimed in claim 1, wherein said projection unit includes a pair of circumferentially extending projections angularly displaced from each other, each of said projections having first and second ends opposite to each other in the circumferential direction and a thickness that gradually increases from said first end to said second end, said groove unit including a pair of grooves that complement said projections.

4. The electric door lock as claimed in claim 1, wherein said projection unit includes a pair of hemispherical projections angularly displaced from each other, said groove unit including a pair of grooves that complement said projections.

5. The electric door lock as claimed in claim 1, wherein said gear member is formed with an axial hole extending from said first gear surface to said second gear surface, said coupling mechanism further including a coupling member having a first coupling surface and a second coupling surface opposite to said first coupling surface, said first coupling surface being formed with a sleeve that is sleeved fittingly on said spindle, said second coupling surface abutting against said first gear surface of said gear member, and an engaging unit including an engaging hole formed in one of said second coupling surface of said coupling member and said first engaging surface of said first engaging member, and an engaging protrusion formed on the other of said second coupling surface of said coupling member and said first engaging surface of said first engaging member, said engaging protrusion extending through said axial hole in said gear member and engaging said engaging hole so as to interconnect co-rotatably said coupling member and said first engaging member while permitting axial movement of said first engaging member between the first and second axial positions.

6. The electric door lock as claimed in claim 5, wherein said coupling mechanism further includes a frame unit, said frame unit including first and second frame parts that cooperate to confine said coupling member, said gear member, and said first engaging member there between, said first frame part permitting at least one of said sleeve of said coupling member and said spindle to extend therethrough, said second frame part permitting movement of said first engaging member therethrough from the first axial position to the second axial position so as to engage said door handle.

7. The electric door lock as claimed in claim 6, wherein said first frame part is formed with a through hole that permits said sleeve of said coupling member to extend therethrough, and an annular wall that surrounds said through hole and that defines a cavity to rotatably confine said coupling member.

8. The electric door lock as claimed in claim 1, wherein said door handle includes:

a space-confining wall that defines a lock-mounting space and that is adapted to be mounted rotatably on the door panel;

a lever extending radially and outwardly from said space-confining wall; and a second engaging member received in said lock-mounting space so as to be co-rotatable with said space-confining wall, said second engaging member being axially movable relative to said space-confining wall between first and second positions, wherein said second engaging member is disengaged from said first engaging member when said first engaging member is in the first axial position and said second engaging member is in the second position such that operation of said lever to rotate said space-confining wall does not result in corresponding rotation of said spindle, wherein said second engaging member engages said first engaging member when said first engaging member is moved to the second axial position and said second engaging member is in the second position such that rotation of said space-confining wall results in corresponding rotation of said spindle, wherein said second engaging member further engages said first engaging member when said first engaging member is in the first axial position and said second engaging member is moved to the first position such that rotation of said space-confining wall results in corresponding rotation of said spindle, said door handle further including an urging member disposed between said first engaging member and said second engaging member for biasing said first engaging member to the first axial position and for biasing said second engaging member to the second position.

9. The electric door lock as claimed in claim 8, wherein said second engaging member has a first engaging end, a second engaging end, and an engaging wall that interconnects said first and second engaging ends, one of said engaging wall of said second engaging member and said space-confining wall being formed with a latching projection, the other of said engaging wall of said second engaging member and said space-confining wall being formed with a retaining notch that engages said latching projection to guide movement of said second engaging member between the first and second positions.

10. The electric door lock as claimed in claim 9, wherein one of said second engaging surface of said first engaging member and said first engaging end of said second engaging member is formed with a locking projection, and the other of said second engaging surface of said first engaging member and said first engaging end of said second engaging member is formed with an engaging notch that engages removably said locking projection to transmit rotation of said second engaging member to said first engaging member.

11. The electric door lock as claimed in claim 8, wherein said door handle further includes a lock core disposed in said lock-mounting space, coupled to said second engaging member, and adapted to be operated by a corresponding key for moving said second engaging member from the second position to the first position.

12. The electric door lock as claimed in claim 11, wherein:

one of said lock core and said second engaging member has a knob formed thereon, the other of said lock core and said second engaging member being formed with a recess, said lock core being rotatable to align said knob with said recess and to permit movement of said knob into said recess so as to dispose said second engaging member in the second position, said lock core being rotatable so as to misalign said knob from said recess and so as to permit movement of said knob out of said recess, thereby moving said second engaging member to the first position.

13. The electric door lock as claimed in claim 1, further comprising a housing adapted to be mounted on the door panel so as to confine said coupling mechanism therein, said door handle being coupled rotatably to said housing.

14. The electric door lock as claimed in claim 1, wherein said coupling mechanism further includes:

a contact switch connected electrically to said motor unit and operable so as to deactivate said motor unit when actuated; and a switch actuator mounted on said gear member for co-rotation therewith and capable of actuating said contact switch.

* * * * *